US006229763B1

(12) United States Patent
Sok

(10) Patent No.: US 6,229,763 B1
(45) Date of Patent: May 8, 2001

(54) TECHNIQUE FOR SETTING TIME OF APPARATUS WHICH RECEIVES SIGNALS FROM ANALOG AND DIGITAL CHANNELS

(75) Inventor: Oh Hun Sok, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/428,715

(22) Filed: Oct. 28, 1999

(30) Foreign Application Priority Data

Oct. 28, 1998 (KR) ..... 98-45342

(51) Int. Cl.[7] ..... G04C 9/00

(52) U.S. Cl. ..... 368/10; 368/46; 368/47; 368/51; 368/55; 368/185; 368/187; 348/554; 348/706

(58) Field of Search ..... 368/46, 51, 55, 368/185, 187; 348/138, 460, 554, 555, 558, 563, 706, 707; 386/13

(56) References Cited

U.S. PATENT DOCUMENTS 4,187,518 * 2/1980 Martin et al. ..... 348/460
4,910,721 * 3/1990 Hayakawa et al. ..... 368/187
5,329,500 * 7/1994 Baik et al. ..... 368/46
5,334,975 * 8/1994 Wachob et al. ..... 368/46
5,583,833 12/1996 Capps et al. .
5,621,458 * 4/1997 Mann et al. ..... 348/563
5,926,228 * 7/1999 Jeon et al. ..... 348/554
5,991,240 * 11/1999 Van Ryzin ..... 368/46
6,169,580 * 1/2001 Shin et al. ..... 348/460

* cited by examiner

*Primary Examiner*—Vit Miska
*Assistant Examiner*—Jeanne-Marguerite Goodwin
(74) *Attorney, Agent, or Firm*—Robert E. Bushnell, Esq.

(57) ABSTRACT

A technique for setting time of an apparatus which receives signals either from a single analog channel and a single digital channel or from a plurality of analog channels and a plurality of digital channels. In the case that the apparatus receives signals from a plurality of analog channels and a plurality of digital channels, a determination is first made as to whether an input signal is from one of the analog or digital channels. Then, if the input signal is determined to be a signal from one of the digital channels, the current time is set based on current time information from the signal of the digital channel. Conversely, if the input signal is determined to be a signal from one of the analog channels, the current time is set based on the current time information from an arbitrary digital channel. Therefore, even on the reception of a signal from the analog channel, the current time can be automatically and accurately set based on the current time information of the digital channel, without need for an additional time setting step.

18 Claims, 2 Drawing Sheets

TECHNIQUE FOR SETTING TIME OF APPARATUS WHICH RECEIVES SIGNALS FROM ANALOG AND DIGITAL CHANNELS

CLAIM OF PRIORITY

This application makes reference to, incorporates the same herein, and claims all benefits accruing under 35 U.S.C. §119 arising from an application for a Device and Method For Setting Time of Apparatus Which Receives Signals From Analog and Digital Channels earlier filed in the Korean Industrial Property Office on Oct. 28, 1998 and there duly assigned Serial No. 45342/1998.

BACKGROUND OF THE INVENTION

1. Field of the Invention

The present invention relates to a technique for setting time in an image processing apparatus in which signals from analog and digital channels are processed, and more particularly, to a device and method for setting time of an apparatus which receives signals from analog and digital channels, in which the current time on reception of a signal from an analog channel is automatically set according to current time information from a digital channel.

2. Description of the Related Art

In earlier image processing apparatus which receives and processes signals from an analog or digital channel, current time information contained in the signal from the digital channel is used to set the current time on the reception of the signal from the digital channel. However, when a signal from the analog channel is received, the current time must be manually set by a user, so that the user is inconvenienced by having to set the time, and the accuracy in setting the time is lowered. U.S. Pat. No. 5,583,833 for a Method and Apparatus for Setting a Clock in a Computer System to Capps et al discloses a digital processor used for setting a real-time clock in a computer system. I have not seen a technique for setting a clock upon reception of an analog signal on an analog channel.

SUMMARY OF THE INVENTION

An object of the present invention is to provide a technique for setting the current time on reception of a signal from an analog channel according to current time information of a signal from a digital channel.

It is also an object to provide a technique for setting the time of a clock of an image processing apparatus upon receipt of an analog signal along an analog channel by setting the clock using an arbitrary digital channel and then outputting the signal of the original analog channel.

According to an aspect of the present invention, there is provided a device for setting times of an image processing apparatus which receives signals from analog and digital channels, the device comprising: a channel decision unit for determining whether an input signal is from the analog or digital channel; a time information receiving unit for receiving current time information from the signal of the digital channel; and a controller for receiving the output from the channel decision unit, setting the current time based on the current time information from the time information receiving unit if the input signal is determined to be a signal from the digital channel, and applying a control signal to the channel selection unit if the input signal is determined to be a signal from the analog channel, to select an arbitrary digital channel and set the current time based on the current time information of the digital channel signal, and then reapplying a control signal to the channel selection unit to output a signal from the original analog channel.

According to another aspect of the present invention, there is provided method for setting times in an image processing apparatus which receives signals from analog and digital channels, the method comprising the steps of: (a) determining whether an input signal is from the analog or digital channel; (b) if the input signal is determined to be a signal from the digital channel, setting the current time based on current time information from the signal of the digital channel; and (c) if the input signal is determined to be a signal from the analog channel, setting the current time based on the current time information from an arbitrary digital channel.

In the step (c) of setting the current time on reception of a signal from the analog channel according to the current time information from a digital channel, if the input signal is determined to be a signal from the analog channel in the step (a), an arbitrary digital channel is selected to obtain the current time information from the signal of the digital channel, and then the current time is set based on the obtained current time information obtained and the original analog channel is reselected.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
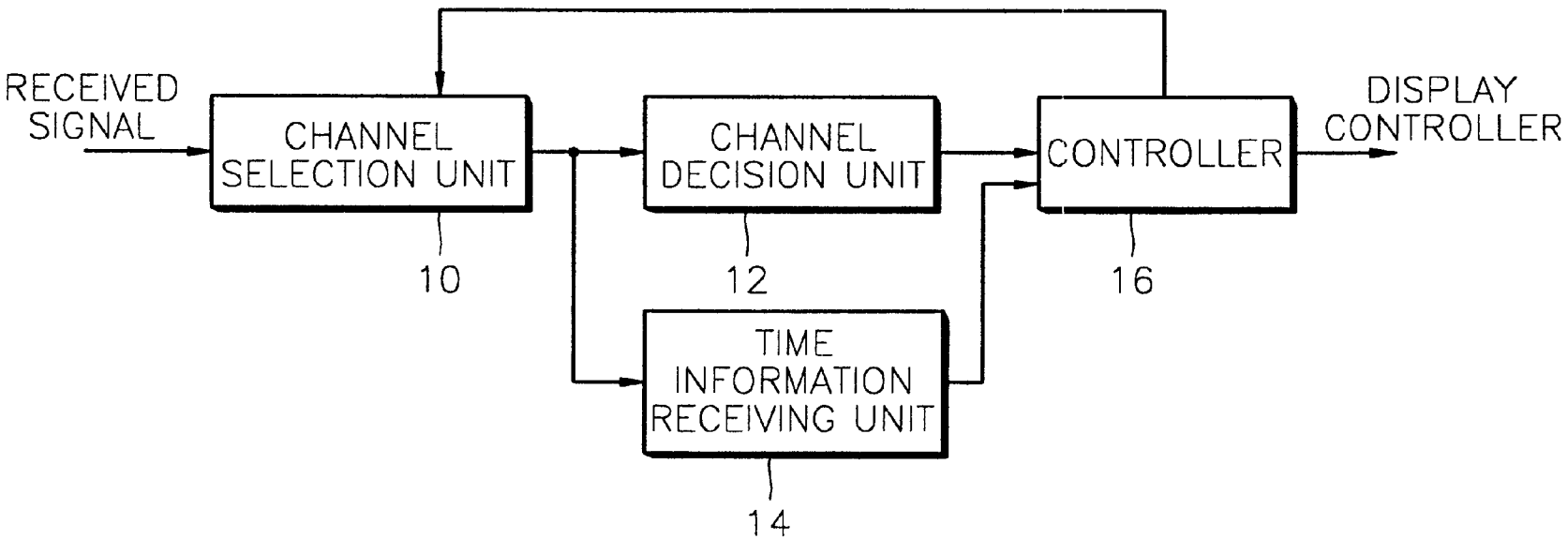
FIG. 1 shows a device for setting time of an apparatus which receives signals from analog and digital channels according to a preferred embodiment of the present invention.

Referring to FIG. 1, a device for setting time of an apparatus which receives signals from analog and digital channels according to a preferred embodiment of the present invention comprises a channel selection unit IO for selecting a signal of a desired channel among received signals, a channel decision unit 12 for determining whether the output signal from the channel selection unit 10 is a signal from the analog or digital channel, a time information receiving unit 14 for receiving current time information from a signal of the digital channel among the signals from the channel selection unit 10, and a controller 16 for setting the current time by receiving the outputs from the time information receiving unit 14 and the channel selection unit 12. When the input signal is determined to be a signal from the digital channel, the controller 16 sets the current time based on the current time information from the time information receiving unit 14. Meanwhile, when the input signal is determined to be a signal from the analog channel, the controller 16 applies a control signal to the channel selection unit 10 to select a signal of an arbitrary digital channel, and sets the current time based on the current time information of the digital channel signal, which is output from the time information receiving unit 14. Then, the controller 16 applies a control signal to the channel selection unit 10 such that a signal of the original analog channel is output. Also, controller 16 outputs the set current time to a display controller to display the current time on a screen according to the need of a user. The display controller generates graphic signals corresponding to time information provided by controller 16, when a user requests the display of a clock, and displays the generated graphic signals to overlap the video signals of the image processing apparatus.

In the time setting device shown in FIG. 1, when a signal of the analog channel is output from the channel selection unit 10, the channel decision unit 12 determines the input signal as the signal from the analog channel and informs the controller 16 of the input of the signal from the analog channel. Then, the controller 16 applies a control signal to the channel selection unit 10 to select an arbitrary digital channel and sets the current time based on the current time information of the digital channel signal output from the time information receiving unit 14. Thereafter, the controller 16 applies a control signal to the channel selection unit 10 to output the signal of the original analog channel. Thus, even though the analog channel is selected, the current time can be automatically and accurately set according to the current time information of the signal from the digital channel.

Figure 2:
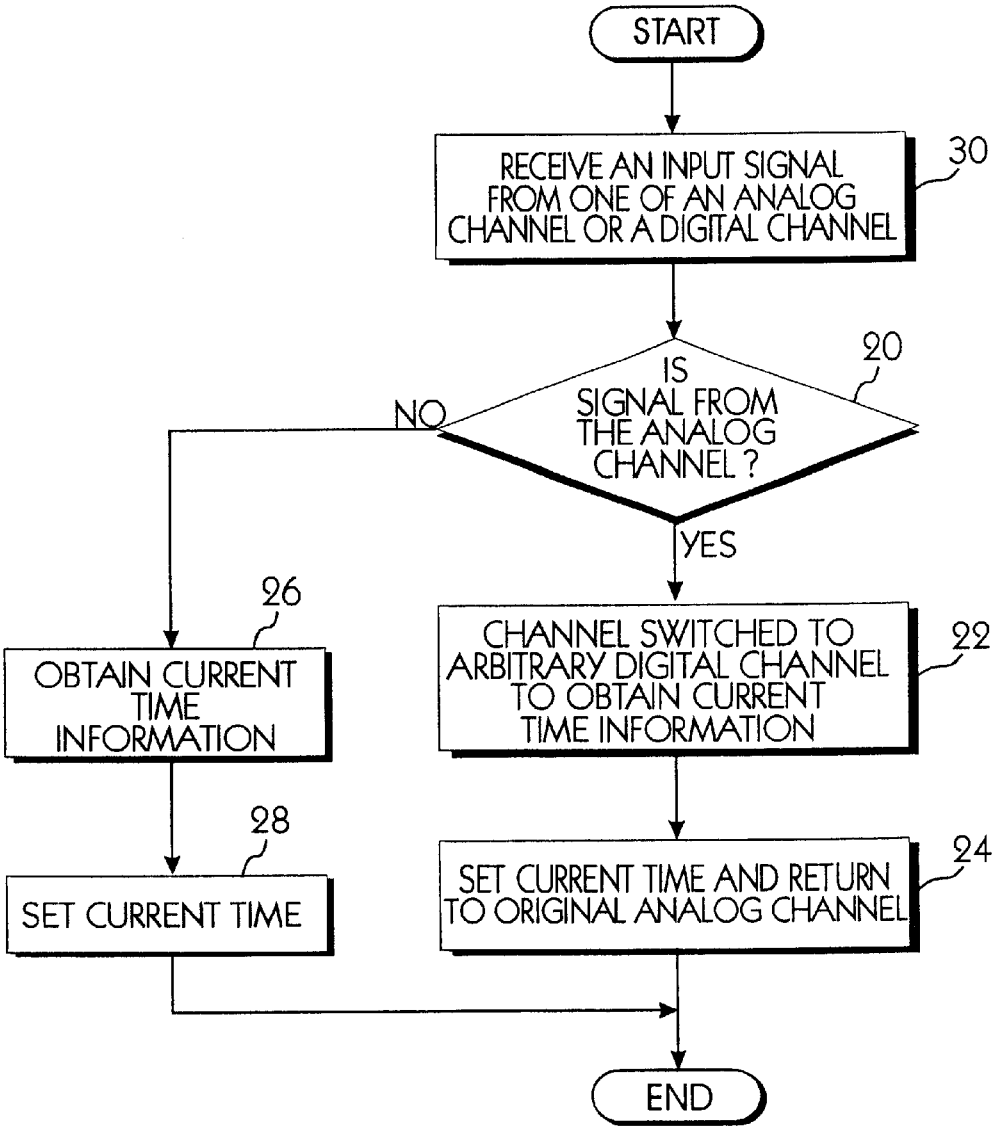
FIG. 2 is a flowchart illustrating a method for setting time in an apparatus which receives signals from analog and digital channels according to a preferred embodiment of the present invention.

FIG. 2 is a flowchart illustrating a method for setting time in an apparatus which receivers signals from analog and digital channels according to a preferred embodiment of the present invention. Although there are a plurality of analog channels and a plurality of digital channels, the present invention can operate with a single analog channel and a single digital channel. Referring to FIG. 2, an input signal is received from one of an analog channel or a digital channel (step 30). Subsequently, a determination as to whether the input signal is a signal from the analog or digital channel (step 20). If the input signal is determined to be a signal from the digital channel, the current time information is input from the signal of the digital channel (step 26) and the current time is set based on the input current time information (step 28).

Meanwhile, if the input signal is determined to be a signal from the analog channel in the step 20, the channel is switched to an arbitrary digital channel to obtain the current time information (step 22). In step 24, the current time is set based on the obtained current time information, and the channel is returned to the original analog channel.

As described above, in the device and method for setting time to the signals from the analog and digital channels according to the present invention, even on the reception of a signal from the analog channel, the current time can be automatically and accurately set based on the current time information of a digital channel, without a need for an additional time setting step.

What is claimed is:

1. A device that sets time in an image processing apparatus, comprising:

a channel selection unit having an input and an output, said input receiving signals from both analog and digital channels, said channel selection unit selecting a signal of a desired channel among received signals from said input;

a channel decision unit having an input and an output, said input of said channel decision unit connected to said output of said channel selection unit, said channel decision unit determining whether an input signal is from either one of said analog or said digital channels;

a time information receiving unit having an input and an output, said input being connected to said output of said channel selection unit, said time information receiving unit receiving current to time information from a signal of one of said digital channels from said output of said channel selection unit; and a controller connected to said output of said channel decision unit and said output of said time information receiving unit, said controller setting the current time based on the current time information from said output of said time information receiving unit if said input of said channel selection unit receives a signal from one of said digital channels, and applying a first control signal from said controller to said channel selection unit if said input of said channel selection unit is determined to be a signal from one of said analog channels, selecting an arbitrary digital channel and set the current time based on the current time information of a signal from said arbitrary digital channel, and then applying a second control signal from said controller to said channel selection unit to output said signal from one of said analog channels.

2. The device of claim 1, further comprising a display controller connected to said controller, wherein the current time is set in said display controller.

3. The device of claim 2, wherein said display controller is a clock.

4. The device of claim 3, wherein said clock is an analog clock.

5. The device of claim 3, wherein said clock is a digital clock.

6. The device of claim 3, wherein said display controller generates graphic signals corresponding to time information provided by said controller when a user requests the display of said clock, and displays said generated graphic signals to overlap video signals of said image processing apparatus.

7. The device of claim 6, further comprised of said display controller generating graphic signals corresponding to visual displays selected by a user from among menu, subtitle and time by manipulation by the user.

8. The device of claim 6, further comprised of said display controller generating graphic signals corresponding to visual displays selected from among menu, subtitle and time in dependence upon a state of a television monitor of said image processing apparatus.

9. A device that sets time in an image processing apparatus, comprising:

a channel selection unit having an input and an output, said input receiving signals from both an analog channel and a digital channel, said channel selection unit selecting a signal of a desired channel among received signals from said input;

a channel decision unit having an input and an output, said input of said channel decision unit connected to said output of said channel selection unit, said channel decision unit determining whether an input signal is from either said analog channel or said digital channel;

a time information receiving unit having an input and an output, said input being connected to said output of said channel selection unit, said time information receiving unit receiving current time information from a signal of said digital channel from said output of said channel selection unit; and a controller connected to said output of said channel decision unit and said output of said time information receiving unit, said controller setting the current time based on the current time information from said output of said time information receiving unit if said input of said channel selection unit receives a signal from said digital channel, and applying a first control signal from said controller to said channel selection unit if said input of said channel selection unit is determined to be a signal from said analog channel, selecting said digital channel and set the current time based on the current time information of a signal from said digital channel, and then applying a second control signal from said controller to said channel selection unit to output said signal from said analog channel.

10. The device of claim 9, further comprising a display controller connected to said controller, wherein the current time is set in said display controller.

11. The device of claim 10, wherein said display controller is a clock.

12. The device of claim 11, wherein said clock is an analog clock.

13. The device of claim 11, wherein said clock is a digital clock.

14. The device of claim 11, wherein said display controller generates graphic signals corresponding to time information provided by said controller when a user requests the display of said clock, and displays said generated graphic signals to overlap video signals of said image processing apparatus.

15. The device of claim 14, further comprised of said display controller generating graphic signals corresponding to visual displays selected by a user from among menu, subtitle and time by manipulation by user.

16. The device of claim 14, further comprised of said display controller generating graphic signals corresponding to visual displays selected from among menu, subtitle and time in dependence upon a state of a television monitor of said image processing apparatus.

17. A method that sets times in an image processing apparatus, comprising the steps of:

providing analog and digital input channels;

determining whether an input signal is from one of said analog channels or one of said digital input channels;

obtaining current time information from said digital input channel if said input signal is from one of said digital input channels;

setting the current time based on current time information from the input signal when said input signal is from one of said digital input channels; and setting the current time based on the current time information from an arbitrary digital channel if the input signal is determined to be a signal from one of said analog channels.

18. The method of claim 17, wherein the step of setting the current time based on the current time information from an arbitrary digital channel if the input signal is determined to be a signal from one of said analog channels comprises the steps of:

selecting an arbitrary digital channel to obtain the current time information from a signal of the arbitrary digital channel; and setting the current time based on the current time information from said signal of said selected arbitrary digital channel; and returning to said input signal of said analog channel.

* * * * *